United States Patent [19]

Katsuyama et al.

[11] Patent Number: 4,844,706

[45] Date of Patent: Jul. 4, 1989

[54] COATING MATERIAL SUPPLY DEVICE

[75] Inventors: Kazuo Katsuyama, Toyota; Yutaka Ohhashi, Aichi; Kenji Fukuta, Toyota, all of Japan

[73] Assignees: Trinity Industrial Corporation, Tokyo; Toyota Jidosha Kabushiki Kaisha, Toyota, both of Japan

[21] Appl. No.: 109,264

[22] Filed: Oct. 14, 1987

[30] Foreign Application Priority Data

Oct. 31, 1986 [JP] Japan ..... 61-258443

[51] Int. Cl.[4] ..... F04B 43/06

[52] U.S. Cl. ..... 417/339; 417/395

[58] Field of Search ..... 417/395, 393, 339, 347

[56] References Cited

U.S. PATENT DOCUMENTS

| | | | |
|---|---|---|---|
| 2,703,055 | 3/1955 | Veth et al. | 417/395 X |
| 3,022,738 | 2/1962 | Krute | 417/347 |
| 3,295,451 | 1/1967 | Smith | 417/347 |

*Primary Examiner*—Leonard E. Smith

*Attorney, Agent, or Firm*—Cushman, Darby & Cushman

[57] ABSTRACT

A coating material supply device capable of accurately supplying even a highly viscous coating material such as a two-component coating material by a constant amount to a coating machine with no trouble, as well as with no requirement of individually disposing flowmeters, e.g., for respective colors in the case of multicolor coating under color-change.

5 Claims, 6 Drawing Sheets

COATING MATERIAL SUPPLY DEVICE

BACKGROUND OF THE INVENTION

1. Field of the Invention

The present invention concerns a coating material supply device for supplying a coating material at a predetermined flow rate to various types of coating machines such as an air atomizing spray gun, an airless atomizing spray gun or an electrostatic atomizing bell or disc type coating machine. More specifically, it relates to a coating material supply device suitable to a case of supplying, e.g., a two-component type coating material comprising a main agent and a curing agent therefor at a predetermined ratio to a coating machine or to a case of supplying coating material of different colors selectively to a coating machine, e.g., in multicolor coating.

2. Description of the Prior Art

In the coating operation, if the flow rate of a coating material supplied from a coating material source to a coating machine is fluctuated, the amount and the area of spraying the coating material may vary to possibly cause unevenness in the coated layers. Accordingly, it is necessary to maintain the flow rate of the coating material supplied to the coating machine always constant.

In view of the above, in the conventional coating material supplying devices, a rotary pump used for supplying the coating material under pressure from a coating material supply source is driven at a constant number of rotation so as to supply a constant amount of coating material to the coating machine.

However, even if the rotary pump is driven at a constant number of rotation, the flow rate of the coating material may vary due to the change in the pressure loss at the suction port or discharge port of the rotary pump depending on the flowing state of the coating material, etc. and there has been a problem, e.g., in a two-component coating material that the main agent and the curing agent therefor can not be supplied at an accurate mixing ratio.

In a two-component type coating material, the main agent and the curing agent supplied separately from their respective reservoirs have to be mixed in a precisely determined ratio upon or just prior to the spraying from the coating machine. If the flow rate for the main agent or the curing agent varies to cause a delicate change in the mixing ratio, no uniform curing can be obtained for the coated layer thus result in unsatisfactory coating such as defective drying or development of crackings in the coated layers.

In view of the above, it has been attempted in the prior art to maintain an accurate flow rate for each of the main agent and the curing agent depending on the mixing ratio by measuring the flow rate for these agents supplied individually from their respective reservoirs by means of a rotary pump to the coating machine by flow meters disposed respectively to the flow channel for the main agent and that for the curing agent, thereby controlling the output from each of the rotary pumps based on the measured values.

However, since most of two-component coating materials are highly viscous as compared with usual paints, it is extremely difficult to accurately measure the flow rate by the flowmeter disposed in the flow channel for the main agent or the curing agent. In addition, there has been a problem that the viscous coating material adheres to the flowmeter thereby causing erroneous operation or failure. Thus, it has been extremely difficult to maintain the flow rate constant upon supplying the coating material to the coating machine.

In order to overcome such problems, use of a supersonic type flowmeter may be considered for contactless external measurement for the flow rate. However, the flowmeter of this kind is not practical for this purpose since it is extremely expensive and results in another problem of picking-up external noises to cause erroneous operation.

Further, use of a gear pump may be considered for supplying a highly viscous paint under pressure. However, there has been a problem that the viscous coating material adheres and clogs at the bearing portion of the gear pump during long time operation to often interrupt the rotation of the pump. In addition, in the case of using a highly viscous paint, particularly, a metallic paint, the metal ingredient is ground by the gear pump failing to obtain uniform coating quality.

Further, in a car coating line where coating materials of multiple colors, e.g., from 30 to 60 kinds of different colors are coated while conducting color-change, since the flow rate of the coating material of each color supplied under pressure from each of the coating material reservoirs by each of the pumps has to be controlled uniformly, it is necessary to dispose a flowmeter for the coating material of each color, which remarkably increases the installation cost.

There have been proposed, for the related prior art, Japanese Patent Application Laying Open Nos. Sho 56-34988, Sho 60-48160, Sho 61-120660, Japanese Utility Model Publication No. Sho 60-17250, Japanese Utility Model Application Laying Open No. Sho 61-191146, etc.

SUMMARY OF THE INVENTION

Accordingly, it is the principal object of the present invention to provide a coating material supply device capable of accurately supplying even a highly viscous coating material such as a two-component coating material by a constant amount to a coating machine with no troubles, as well as with no requirement of individualy disposing flowmeters, e.g., for respective colors in the case of multicolor coating under color-change.

It is another object of the present invention to provide a coating material supply device capable of supplying the coating material continuously, e.g., in line coating.

It is a further object of the present invention to provide a coating material supply device capable of supplying the coating material always at a constant flow rate with no transient fluctuation.

It is a still further object of the present invention to provide a coating material supply device of the aforementioned constitution capable of rapidly and surely detecting the failure in diaphragms, etc.

It is a yet further object of the present invention to provide a coating material supply device suitable to the application use, for example, in multicolor coating apparatus.

The foregoing principal object of the present invention can be attained by a coating material supply device in which coating material is pumped out at a predetermined flow rate and supplied at a constant flow rate to a coating machine, wherein the device comprises:

hydraulically-powered reciprocal pumping means connected to the coating machine and having an inlet for coating material supplied from a coating material supply source and an exit for discharging the coating material by the pressure of hydraulic fluid supplied at a constant flow rate from a hydraulic fluid supply source and means for closing the flow channel on the side of the inlet for the coating material when the coating material is discharged from the exit for the coating material and means for closing the flow channel on the side of the exit when the coating material is supplied to the inlet.

Another object of the present invention, i.e. continuous supply of the coating material can be attained by a coating material supply device of the afore-mentioned constitution wherein the device comprises:

a plurality of hydraulically-powered reciprocal pumping means connected in parallel with each other to the coating machine and adapted to be operated successively and selectively in a predetermined sequence.

The further object of the present invention, i.e. supply of the coating material with no fluctuations can be attained by a paint supply device in which coating material is pumped out at a predetermined flow rate and supplied at a constant flow rate to a coating machine, wherein the device comprises:

a plurality of hydraulically-powered reciprocal pumping means connected in parallel with each other to the coating machine and adapted to operate successively and selectively in a predetermined sequence, each of the pumping means having an inlet for the coating material supplied from a coating material supply source and an exit for discharging the coating material by the pressure of hydraulic fluid supplied at a constant flow rate from a hydraulic fluid supply source and adapted such that the supply of the hydraulic fluid to a hydraulically-powered reciprocal pump to be operated next in the operation sequence is started at a predetermined time before interrupting the supply of the hydraulic fluid to other hydraulically-powered reciprocal pump currently supplying the hydraulic fluid at a constant flow rate to the coating machine.

The afore-mentioned object can also be attained in another feature of the invention by a coating material supply device in which coating material is pumped out at a predetermined flow rate and supplied at a constant flow rate to a coating machine, wherein the device comprises:

a plurality of hydraulically-powered reciprocal pumping means connected in parallel with each other to the coating machine and adapted to be operated successively and selectively in a predetermined sequence, each of the pumping means having an inlet for the coating material supplied from a coating material supply source and an exit for discharging the coating material by the pressure of hydraulic fluid supplied at a constant flow rate from a hydraulic fluid supply source, a pressure sensor for detecting the pressure of the coating material being supplied from each of the hydraulically-powered reciprocal pumps to the coating machine and a pressure control valve that controls the pressure of the coating material supplied to the hydraulically-powered reciprocal pump to be operated next in the operation sequence to the same level as that for the pressure of the coating material being supplied at a constant flow rate to the coating machine based on the pressure detection signal of the pressure sensor.

The afore-mentioned object can also be attained in a further feature of the invention by a paint supply device of the constitution just mentioned above and further comprises:

a pressure control device that controls the pressure of the hydraulic fluid supplied to a hydraulically-powered reciprocal pump currently supplying the coating material to the coating machine equal to the pressure of the hydraulic fluid discharged from a hydraulically-powered reciprocal pumps to be operated next in the operation sequence by the pressure of the coating material supplied thereto, in which the pressure control device comprises a diaphragm or piston actuated by the difference of pressures of the hydraulic fluids acted on both sides thereof and valves opened and closed by a needle interlocking with the diaphragm or piston, the valve causing to open the flow channel of the hydraulic fluid discharged from the hydraulically-powered reciprocal pump when the pressures of both of the hydraulic fluids acting on both sides of the diaphragm or piston are balanced to each other.

The still further object of the present invention, i.e., failure detection for diaphragms, etc. can be attained by a coating material supply device of any of the aforementioned constitutions in which the hydraulically-powered reciprocal pumping means comprise diaphragm type pumping means, wherein a diaphragm comprises an electroconductive reinforcing member and an electrically insulation member coated over the entire surface thereof and is combined with an electrical circuit including a path consisting of the electroconductive reinforcing member, insulation member and an electroconductive coating material or electroconductive hydraulic fluid in the double-acting pumping means, the electrical circuit also including a detection section that detects the breakage caused to the diaphragm depending on the conduction state of the path.

The just mentioned object of the invention can also be attained by a coating material supply device of any one of the afore-mentioned constitutions in which the hydraulically-powered reciprocal pumping means comprise diaphragm type pumping means, wherein the device further comprises a detection means that detects the breakage of the diaphragm depending on the optical change caused in the hydraulic fluid when the coating material supplied to the reciprocal pumping is mixed into the hydraulic fluid.

The yet further object of the present invention in tended for application, e.g., to multicolor coating can be attained by the coating material supply device in which coating material is pumped out at a predetermined flow rate and supplied at a constant flow rate to a coating machine, wherein the device comprises:

a plurality of hydraulically-powered reciprocal pumping means, each having an inlet for the coating material supplied from a coating material supply source and an exit for discharging the coating material by the pressure of hydraulic fluid supplied at a constant flow rate from a hydraulic fluid supply source, connected to coating material selection valves connected in parallel with each other to the coating machine, and connected to switching valves that selectively switch the flow channel for the hydraulic fluid supplied from the hydraulic fluid supply source in response to the switching operation of the coating material selection valves, in which a flow rate control mechanism for maintaining the flow rate of the hydraulic fluid constant is disposed to the flow channel for the hydraulic fluid between the hydraulic fluid supply source and the switching valves.

DESCRIPTION OF THE ACCOMPANYING DRAWINGS

These and other objects, as well as advantageous features of the present invention will become apparent by the description for the preferred embodiments thereof referring to the accompanying drawings, wherein FIG. 1 is a flow sheet showing a preferred embodiment of the coating material supply device according to the present invention;

FIG. 2 is a time chart illustrating the operation of the device;

FIG. 3 though FIG. 6 are, respectively, explanatory views illustrating means for detecting the occurrence of diaphragm failure in a hydraulically-powered reciprocal pump;

FIG. 7 though FIG. 10 are, respectively, explanatory views illustrating means for controlling the pressure of a coating material supplied from a coating material supply source to a hydraulically-powered reciprocal pump; and FIG. 11 is a flow sheet illustrating a preferred embodiment of the present invention applied to a multicolor coating apparatus.

DESCRIPTION OF THE PREFERRED EMBODIMENTS

Figure 1:
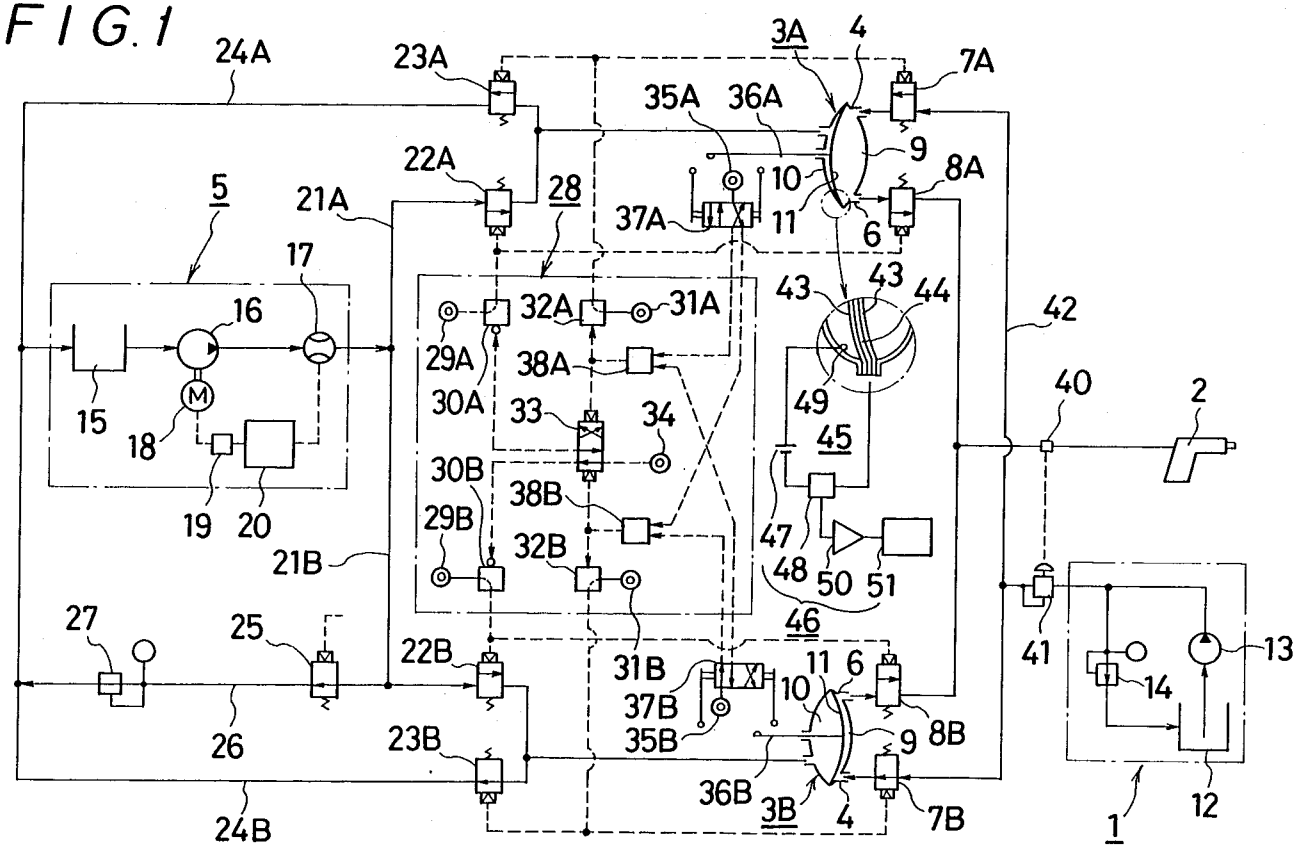

FIG. 1 is a flow sheet illustrating one embodiment of the device for supplying coating material according to the present invention in which a coating material supplied from a coating material supply source 1 is discharged at a predetermined flow rate and supplied in a constant flow rate to a coating machine 2 by a pair of hydraulically-powered reciprocal pumps 3A and 3B, which are connected in parallel with each other to the coating machine 2 and actuated alternately one after the other.

In each of the hydraulically-powered reciprocal pumps 3A, 3B, coating material supplied from the coating material supply source 1 and charged from an inlet 4 for coating material is pumped out from an exit 6 for coating material by the pressure of hydraulic fluid supplied at a constant flow rate from a hydraulic fluid supply source 5. Each of ON-OFF valves 7A, 7B disposed to the flow channel on the side of the inlet 4 is closed when the coating material is pumped out from the exit 6, whereas each of ON-OFF valves 8A, 8B disposed to the flow channel on the side of the exit 6 is closed when the coating material is charged from the inlet 4.

In each of the hydraulically-powered reciprocal pumps 3A and 3B, a coating material chamber 9 having the inlet 4 and the exit 6 and a hydraulic fluid chamber 10 receiving the supply of the hydraulic fluid are formed in adjacent with each other by way of a diaphragm 11, so that the coating material in the coating material chamber 9 is pumped out at a constant low rate by the diaphragm 11 actuated by the pressure of the hydraulic fluid supplied at a predetermined flow rate from the hydraulic fluid supply source 5 to the hydraulic fluid chamber 10.

The coating material supply source 1 comprises a reservoir 12 storing the coating material, a rotary pump 13 for supplying the coating material in the reservoir 12 under pressure to the coating material chamber 9 in each of the hydraulically-powered reciprocal pump 3A, 3B, and a back pressure valve 14 for controlling the pressure of the coating material supplied under pressure by the pump 13.

The hydraulic fluid supply source 5 comprises a reservoir 15 for storing the hydraulic fluid, a rotary pump 16 such as a gear pump for supplying the hydraulic fluid under pressure in the reservoir 15 to the hydraulic fluid chamber 10 of each of the hydraulically-powered reciprocal pumps 3A, 3B, a flow sensor 17 for detecting the flow rate of the hydraulic fluid supplied under pressure by the pump 16, and a flow rate control device 20 that outputs a control signal to an inverter 19 for varying the number of the rotation of a driving motor 18 for the rotary pump 16 based on a detection signal from the flow sensor 17. The flow rate control device 20 is so adapted that it compares the flow rate of the hydraulic fluid detected by the flow sensor 17 with a predetermined flow rate of the hydraulic fluid depending on the flow rate of the coating material supplied to the coating machine 2 and, if there is any difference therebetween, outputs a control signal that variably controls the number of rotation of the driving motor 18 depending on the deviation.

The hydraulic fluid supplied under pressure at a constant flow rate is supplied alternately to each of the hydraulic fluid chambers 10 of the hydraulically-powered type reciprocal pumps 3A, 3B by the switching of ON-OFF valves 22A, 22B disposed respectively in supply channels 21A, 21B branched two ways. The hydraulic fluid discharged from the hydraulic fluid chambers 10 is recycled by way of ON-OFF valves 23A, 23B through discharged channels 24A, 24B respectively to the inside of the tank 15.

Further, a short-circuit channel 26 having a relief valve 25 disposed therein is connected between the supply flow channels 21A, 21B and the discharged flow channels 24A, 24B for recycling the hydraulic fluid supplied under pressure from the tank 15 by the rotary pump 16 directly to the reservoir 15. The circuit 26 is disposed for preventing an excess load from exerting on the rotary pump 16 when both of the ON-OFF valves 22A and 22B are closed.

The relief valve 25 is adapted to be closed and opened interlocking with a trigger member attached to the coating machine 2 and closed only when the coating material is sprayed by triggering the coating machine 2. A back pressure valve 27 is disposed to the short circuit channel 26 for controlling the pressure of the hydraulic fluid supplied under pressure through the supply channels 21A, 21B.

The hydraulic fluid is preferably composed of such material as causing less troubles even when the diaphragm 11 put between the coating material chamber 9 and the hydraulic fluid chamber 10 in each of the hydraulically-powered reciprocal pumps 3A, 3B is broken and the hydraulic fluid is mixed with the coating material. Further the hydraulic fluid should be selected so that the flow rate can reliably be measured with no troubles by the flow sensor. For instance, water is used in the case where aqueous coating material is employed, whereas hydraulic oil such as dioctyl phthalate ($C_{24}H_{38}O_4$), etc. is used when a resin type coating material is employed.

The block 28 surrounded by a dotted line in FIG. 1 represents an air control device for controlling the ON-OFF operation of the ON-OFF valves 7A, 7B, 8A, 8B, the ON-OFF valves 22A, 22B and the ON-OFF valves 23A, 23B for alternately actuating the hydraulically-powered reciprocal pumps 3A, 3B thereby continuously supplying the coating material at a constant amount to the coating machine 2.

Briefly speaking, the air control device 28 is so constituted that the ON-OFF valves 8A and 22A, or the ON-OFF valves 8B and 22B are opened by pressurized air supplied from air supply sources 29A and 29B by way of OFF-delay timers 30A and 30B respectively, while the ON-OFF valves 7A and 23A, or the ON-OFF valves 7B and 23B are opened respectively by the pressurized air supplied from air supply sources 31A and 31B by way of ON-delay timers 32A and 32B respectively.

The OFF delay timer 30A or 30B normally allows the pressurized air supplied from the air supply source 29A, 29B to pass to the respective ON-OFF valves and, when an air signal is inputted from a signal air supply source 34 by the switching of a piston valve 33, interrupts the pressurized air supplied from the air supply source 29A or 29B to the respective ON-OFF valves after the elapse of a predetermined of time (for example 0.2 sec after).

While on the other hand, ON-delay timer 32A or 32B normally interrupts the pressurized air supplied from the air supply source 31A, 31B to the respective On-OFF valves and, when an air signal is inputted from signal air supply source 31A or 31B described later, allows the pressurized air from the air supply source 31A or 31B to pass to the respective ON-OFF valves after the elapse of a predetermined of time (for example, 0.4 sec after).

Signal air supply sources 35A and 35B are disposed for operating the ON-delay timers 32A, 32B, as well as for switching the piston valve 33, by supplying air signals to the ON-delay timers 32A, 32B and the piston valve 33 through piston valves 37A, 37B that are switched by reciprocally moving rods 36A, 36B attached respectively to diaphragms 11, 11 of the hydraulically-powered reciprocal pumps 3A, 3B and through AND gates 38A, 38B. Each of the AND gates 38A, 38B has such a logic function of generating an air signal only when air signals are inputted from both of the signal air supply sources 35A and 35B. When the air signal is outputted, the ON-delay timer 32A or 32B is operated after the elapse of a predetermined time to allow the pressurized air supplied from the air supply source 31A, 31B to pass therethrough to the ON-OFF valve, as well as the piston valve 33 is switched.

The air supply source 29A or 29B is so adapted to be interlocked with the triggering action for the coating machine 2 and output the pressurized air only while the coating material is triggered for spraying.

While on the other hand, pressurized air is always outputted from the air supply sources 31A, 31B, 34, 35A and 35B irrespective of the trigger for the coating machine 2.

A pressure sensor 40 is disposed to the flow channel for the coating material supplied from each of the hydraulically-powered reciprocal pumps 3A, 3B to the coating machine for detecting the pressure thereof. A pressure control valve 41 is disposed so that it is actuated based on a pressure detection signal from the pressure sensor 40 that detects the pressure of the coating material supplied, for example, from the hydraulically-powered reciprocal pump 3A to the coating machine 2 and controls the pressure of the coating material supplied to the hydraulically-powered reciprocal pump 3B going to be actuated next in the operation sequence to the same level as that for the pressure of the coating material being currently supplied at a constant amount from the hydraulically-powered reciprocal pump 3A to the coating machine 2.

The pressure control valve 41 is disposed to the flow channel 42 of the coating material supplied under pressure from the coating material supply source 1 to the hydraulically-powered acting reciprocal pumps 3A, 3B. The pressure control valve 41 may alternatively be disposed to the flow channel 24A, 24B for the hydraulic fluid which is discharged from the hydraulic fluid chamber 10 of each of the hydraulically-powered reciprocal pumps 3A, 3B by the pressure of the coating material supplied from the coating material supply source 1 to the coating material chamber 9 in each of the hydraulically-powered reciprocal pumps 3A, 3B.

In this illustrated embodiment, the diaphragm 11 used for isolating the coating material in the chamber 9 and the hydraulic fluid in the chamber 10 in each of the hydraulically-powered reciprocal pumps 3A, 3B comprises electrically insulating members 43, 43 made of resilient rubber sheet, plastic sheet, etc. coated on both surfaces of an electroconductive reinforcing member 44 made of an electroconductive plastic sheet, metal net, carbon fibers, etc.

As shown by an enlarged view in FIG. 1 for the portion of the diaphragm 11 indicated within a dotted chain circle, an electric circuit 45 having a power source 47 and a current or voltage detector 48 is formed including a path comprising an electrode 49 for the anode of the power source 47→electorconductive hydraulic fluid in the chamber 10→insulation member 43→the electroconductive reinforcing member 44. The output of the circuit 45 is taken out to a detection circuit 46 that detects the breakage, if any, in the diaphragm 11 depending on the change in the current or resulted when the diaphragm 11 is broken to render the normally insulated path conductive.

The breakage detection circuit 46 comprises an amplifier 50 for amplifying the detection signal from the detector 48 and an alarm device 51 that generates an alarm sound and flickers an alarm lamp based on the detection signal inputted from the amplifier 50.

The actual operation of one embodiment of the coating material supply device shown in FIG. 1 will be explained referring to the time chart shown in FIG. 2.

Figure 2:
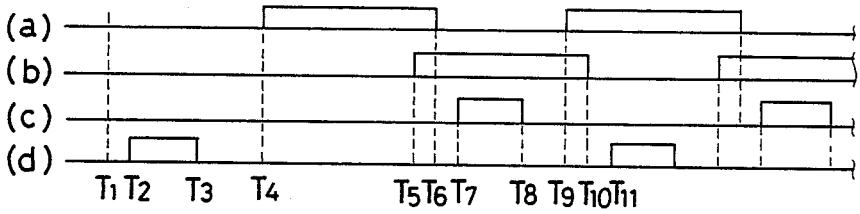

In FIG. 2, (*a*) and (*b*) show the state of supplying the hydraulic fluid to the hydraulically-powered reciprocal pumps 3A, 3B, while (*c*) and (*d*) show the state of supplying the coating material to the hydraulically-powered reciprocal pumps 3A and 3B respectively.

At first, the flow rate of the hydraulic fluid to be supplied from the hydraulic fluid supply source 5 to each of the hydraulically-powered reciprocal pumps 3A, 3B is previously set to the flow rate control device 20 in accordance with a required flow rate of the coating material to be supplied in a constant amount from the hydraulically-powered reciprocal pumps 3A, 3B to the coating machine.

Then, the rotary pump 16 is started for supplying the hydraulic fluid stored in the reservoir 15 under pressure and, at the same time, the operation of the air control device 28 is started (at $T_1$ in FIG. 2).

In this instance, both of the ON-OFF valves 22A and 22B are closed and, accordingly, the hydraulic fluid supplied under pressure by the rotary pump 16 is directly recycled to the inside of the reservoir 15 by way of the short-circuit channel 26 having the relief valve 25 and the back pressure valve 27.

It is assumed here that the coating material supplied from the supply source 1 has been charged in the coating material chamber 9 of the hydraulically-powered reciprocal pump 3A, while the coating material has been completely discharged from the inside of the coating material chamber 9 of the hydraulically-powered reciprocal pump 3B.

In this state, if the piston valves 37A and 37B are in the state as shown in FIG. 1, the pressurized air supplied from the signal air supply sources 35A and 35B are inputted as air signals to the AND gate 38B and then outputted from the AND gate 38B to the ON-delay timer 32B and the piston valve 33.

The timer 32B allows the pressurized air supplied from the air supply source 31B to pass therethrough for opening the ON-OFF valves 7B and 23B, for example, after the elapse of 0.4 sec. Then, the coating material is supplied from the coating material supply source 1 by way of the valve 7B to the coating material chamber 9 of the hydraulically-powered reciprocal pump 3B and, at the same time, the hydraulic fluid is discharged from the inside of the hydraulic fluid chamber 10 by the pressure of the coating material by way of the valve 23B and then recycled through the discharge channel 24B to the inside of the reservoir 15 ($T_2$ in FIG. 2).

In this state, the ON-OFF valve 8B disposed to the exit 6 for coating material of the hydraulically-powered reciprocal pump 3B is kept closed.

Then, as the coating material is supplied to the coating material chamber 9 of the hydraulically-powered reciprocal pump 3B, the diaphragm 11 is expanded toward the hydraulic fluid chamber 10 and the piston valve 35B is switched by the rod 36B interlocking with the diaphragm 11.

Since the air signal outputted so far from the signal air supply source 35B to the AND gate 38B is now switched to the AND gate 38A, the ON-delay timer 32B interrupts the supply of the pressurized air from the air supply source 31B to close the ON-OFF valves 7B and 23B to interrupt the supply of the coating material to the hydraulically-powered reciprocal pump 3B ($T_3$ in FIG. 2).

Then, when the coating machine 2 is triggered, the pressurized air from the air supply sources 29A and 29B is outputted to open the ON-OFF valve 8A disposed to the flow channel on the exit 6 for coating material of the hydraulically-powered reciprocal pump 3A and, at the same time, open the ON-OFF valve 22A disposed in the supply channel 21A for supplying the hydraulic fluid from the hydraulic fluid supply source 5 to the hydraulic fluid chamber 10 of the hydraulically-powered reciprocal pump 3A.

Thus, the coating material charged in the coating material chamber 9 of the hydraulically-powered reciprocal pump 3A is pumped out from the exit 6 by the pressure of the hydraulic fluid supplied at a constant flow rate into the hydraulic fluid chamber 10 and then supplied to the coating machine 2 at a constant flow rate depending on the flow rate of the hydraulic fluid ($T_4$ in FIG. 2).

That is, the piston valve 33 sends the air signal outputted from the signal air supply source 34 to the OFF-delay timer 30B, to keep the OFF-delay timer 30B interrupted, while the other OFF-delay timer 30A is operated. Then, the ON-OFF valves 8A, 22A are opened by the pressurized air supplied from the air supply source 29A to the OFF-delay timer 30A, by which the hydraulic fluid is supplied from the hydraulic fluid supply source 5 to the hydraulic fluid chamber 10 of the hydraulically-powered reciprocal pump 3A, to displace the diaphragm 11 toward the coating material chamber 9, by which the coating material is pumped out from the coating material chamber 9 at the same flow rate as that of the hydraulic fluid and supplied by the constant amount to the coating machine 2.

Since the flow rate of the hydraulic fluid supplied to the hydraulically-powered reciprocal pump 3A is maintained constant by the flow rate control device 20, the flow rate of the coating material supplied to the coating machine 2 is maintained at a predetermined desired flow rate.

Then, just before the coating material in the coating material chamber 9 of the hydraulically-powered reciprocal pump 3A is completely pumped out by the diaphragm 11, the piston valve 37A is switched by the rod 36A interlocking with the diaphragm 11. Therefore, the air signals from both of the signal air supply sources 35A and 35B are inputted to the AND gate 38A and the gate 38A outputs the air signal to operate the ON-delay timer 32A. The air signal is also sent to the piston valve 33 to turn the valve and the air signal outputted so far from the signal air supply source 34 to the OFF-delay timer 30B is now outputted to the OFF-delay timer 30A ($T_5$ in FIG. 2).

That is, by the switching of the piston valve 33, the OFF-delay timer 30A which was operated so far is shut, for example, after the elapse of 0.2 sec, to close the ON-OFF valves 8A and 22A thus stop the supply of the coating material from the hydraulically-powered reciprocal pump 3A to the coating machine 2 ($T_6$ in FIG. 2).

Further, when the piston valve 33 is switched, since the output of the air signal from the signal air supply air source 34 to the OFF-delay timer 30B is interrupted to thereby operate the timer 30B, the ON-OFF valves 8B and 22B are opened to start the constant supply of the coating material also from the hydraulically-powered reciprocal pump 3B to the coating machine 2, 0.2 sec before the interruption of the OFF-delay timer 30A and thus the closure of the ON-OFF valves 8A and 22A ($T_5$ in FIG. 2).

That is, the coating material is supplied from both of the hydraulically-powered reciprocal pumps 3A and 3B to the coating machine 2 while being overlapped for 0.2 sec.

In this instance, the flow rate of the hydraulic fluid supplied from the hydraulic fluid supply source 5 is always maintained constant by the flow rate control device 20 and, accordingly, the total flow rate of the hydraulic fluid supplied simultaneously to the pair of the hydraulically-powered reciprocal pumps 3A and 3B is equal to the flow rate in a case where the hydraulic fluid is supplied only to one of the hydraulically-powered reciprocal pumps 3A and 3B. Therefore, the flow rate of the coating material supplied to the coating machine 2 does not fluctuate.

Accordingly, upon switching of the alternately operating hydraulically-powered reciprocal pumps 3A, 3B, it is possible to avoid the momentary interruption of the coating material supply to the coating machine 2, which would otherwise cause transient pulsation to the coating material during supply to the coating machine 2. Therefore, undesired breathing phenomenon that the spray amount of the coating material from the coating machine 2 is instantaneously reduced is surely prevented and the coating material can always be sprayed continuously at a constant amount from the coating machine 2.

Then, after the piston valve 37A has been switched as described above, the ON-delay timer 32A is conducted with a predetermined time delay of 0.4 sec (that is, after the elapse of 0.2 sec from the closure of the ON-OFF valves 8A and 22A) and the ON-OFF valves 7A and 23A are opened by the pressurized air supplied from the air supply source 31A. Accordingly, the coating material is supplied from the coating material supply source 1 to the coating material chamber 9 of the hydraulically-powered reciprocal pump 3A and, at the same time, the hydraulic fluid is discharged from the hydraulic fluid chamber 10 of the hydraulically-powered reciprocal 3A and returned by way of the discharge channel 24A to the inside of the reservoir 15 of the hydraulic fluid supply source 5 ($T_7$ in FIG. 2).

Then, if the amount of the coating material supplied to the coating material chamber 9 of the hydraulically-powered reciprocal pump 3A reaches a predetermined amount, the piston valve 37A is switched by the rod 36A interlocking with the diaphragm 11, by which the output of the air signal from the AND gate 38A is stopped and the ON-OFF valves 7A and 23A are closed again ($T_8$ in FIG. 2).

When the coating material is supplied from the coating material supply source 1 to the hydraulically-powered reciprocal pump 3A, the pressure of the coating material supplied is controlled to the same level as that for the pressure of the coating material currently supplied at a constant amount from the other hydraulically-powered reciprocal pump 3B to the coating machine 2. Such a pressure control is attained by detecting the pressure of the coating material supplied from the hydraulically-powered reciprocal pump 3B by the pressure sensor 40 and controlling the pressure of the coating material supplied to the pump 3A by the pressure control valve 41 based on the pressure detection signal from the pressure sensor 40.

Then, just before the coating material in the coating material chamber 9 of the hydraulically-powered reciprocal pump 3B is completely discharged, the piston valve 37B interlocking with the diaphragm 11 of the hydraulically-powered reciprocal pump 3B is switched and the air signal is outputted from the AND gate 38B to start the ON-delay timer 32B. At the same time, the piston valve 33 is switched to stop the output of the air signal from the signal air supply source 34 to the OFF-delay timer 30A and the supply of the air signal is now switched to the OFF-delay timer 30B ($T_9$ in FIG. 2).

Accordingly, the OFF-delay timer 30B kept operated so far is shut after the elapse of 0.2 sec from the switching of the piston valve 37B to close the ON-OFF valves 8B and 22B, by which the supply of the coating material from the hydraulically-powered reciprocal pump 3B to the coating machine 2 is completely stopped ($T_{10}$ in FIG. 2).

While on the other hand, when the piston valve 37B is switched as described above, the output of the air signal to the OFF-delay timer 30A is interrupted and the OFF-delay timer 30A shut so far is now operated which opens the ON-OFF valves 8A and 22A 0.2 sec before the closure of the ON-OFF valves 8B and 22B. Thus, the supply of the coating material from the hydraulically-powered reciprocal pump 3A to the coating machine 2 is started just before the supply of the coating material from the hydraulically-powered reciprocal pump 3B to the coating machine 2 is stopped ($T_9$ in FIG. 2).

Further, upon switching the piston valve 37B as described above, the ON-delay timer 32B is operated after the elapse of 0.4 sec to open the ON-OFF valves 7B and 28B by the pressurized air supplied from the air supply source 31B, by which the supply of the coating material from the coating material supply source 1 to the coating material chamber 9 of the hydraulically-powered reciprocal pump 3B is started at the same pressure as that for the coating material currently supplied from the hydraulically-powered reciprocal pump 3A to the coating machine 2 and, at the same time, the hydraulic fluid is discharged from the hydraulic fluid chamber 10 of the hydraulically-powered reciprocal pump 3B and returned to the hydraulic fluid supply source 5 ($T_{11}$ in FIG. 2).

In this way, the foregoing operations of the coating material supply device are repeated hereinafter and the coating material is supplied continuously at a predetermined amount from the hydraulically-powered reciprocal pumps 3A and 3B to the coating machine 2.

As has been described above according to the present invention, the coating material discharged alternately from each of the hydraulically-powered reciprocal pumps 3A, 3B can be supplied always at a constant flow rate to the coating machine by controlling the flow rate of the hydraulic fluid supplied to the hydraulically-powered reciprocal pumps 3A, 3B to a constant level.

Accordingly, it is no more required in the present invention for the direct detection of the flow rate of the coating material supplied to the coating machine 2 but it is only necessary to detect the flow rate of the hydraulic fluid supplied from the hydraulic fluid supply source 5 to the hydraulically-powered reciprocal pumps 3A, 3B by the flow sensor 17. Therefore, there is no worry that misoperations or troubles are caused to the flow sensor even if highly viscous coating material is used.

Further, since each of the hydraulically-powered reciprocal pumps 3A, 3B is so adapted that the flow channel on the side of the inlet 4 for coating material is closed during discharging of the coating material from the exit 6, while the flow channel on the side of the exit 6 is closed when the coating material is being charged to the coating inlet 4, the flow rate of the coating material supplied to the coating machine 2 does not suffer from the effect by the pressure of the coating material supplied under pressure from the coating material supply source 1. In addition, the coating material supplied under pressure from the coating material supply source 1 can surely be charged into the coating material chamber 9 with no undesired direct supply to the coating machine 2 (short-pass) while reliably discharging the hydraulic fluid in the hydraulic fluid chamber 10.

Further, since the coating material is discharged from both of the hydraulically-powered reciprocal pumps 3A, 3B while being overlapped to each other for a predetermined of time just before their operations are switched with each other, supply of the coating material to the coating machine 2 does not interrupt even for a brief moment thereby enabling to prevent the pulsation in the coating material during supply to the coating machine 2, which would otherwise cause fluctuation in the spraying amount of the coating material from the coating machine 2.

Furthermore, since the pressure sensor 40 and the pressure control valve 41 are disposed, the coating material can be supplied to the coating material chamber 9 of one of the hydraulically-powered reciprocal pumps 3A, 3B at the same pressure as that of the coating material being supplied from the other of the hydraulically-powered reciprocal pumps 3A, 3B to the coating machine 2 and, accordingly, there is no worry that pulsation is resulted due to the pressure difference between coating materials discharged from both of the hydraulically-powered reciprocal pumps 3A, 3B when the pumping operation is switched between them.

Accordingly, the flow rate of the coating material continuously supplied to the coating machine 2 by alternately operating the hydraulically-powered reciprocal pumps 3A, 3B can always be maintained at an exact flow rate which is determined only by the flow rate of the hydraulic fluid maintained at a constant flow rate by the flow rate control device 20 with no worry of resulting in uneven coating or the like.

In the coating material supply device according to the present invention, if a diaphragm used in the hydraulically-powered reciprocal pumps is worn out to lose it function for isolating the coating material and the hydraulic fluid, such a failure should rapidly and reliably be detected, becaue the failure such as breakage of the diaphragm may lead to undesirable mixing of the coating material and the hydraulic fluid.

If crackings etc. are developed through the diaphragm 11 shown in FIG. 1, the electroconductive hydraulic fluid is in direct contact with the electroconductive reinforcing material 44 covered between the insulating members 43, 43, and the electrical circuit 45 is rendered conductive by way of the path including the electrode 49, the electroconductive hydraulic fluid present at the inside of the hydraulic fluid chamber 10 and the electroconductive reinforcing member 44. Then, an electrical current from the power source 47 flows through the detector 48 disposed in the electric circuit 45 and the voltage (current) change detected by the detector 48 is amplified by the amplifier 50 and then inputted to the alarm device 51 to generate an alarm sound and, at the same time, flickers an alarm lamp to inform the failure of the diaphragm 11.

Thus, the development of cracking in the diaphragm 11 can rapidly be detected thereby enabling operators to take adequate countermeasures for defective coating due to the mixing of the hydraulic fluid into the coating material supplied to the coating machine 2.

In a case where an electroconductive coating material such as an aqueous coating material or metallic coating material is used, the electrode 49 for the electrical circuit 45 may be disposed in the coating material chamber 9 instead of the hydraulic fluid chamber 10.

The detection means for the breakage of the diaphragm 11 may be constituted in various modes, not restricted only to the electrical embodiment shown in FIG. 1.

In FIG. 3 through FIG. 6, optical detection means is disposed to the discharge channel 24A, 24B for the hydraulic fluid and the optical change of the hydraulic fluid caused by the mixing of the coating material and the hydraulic fluid is detected to inform the breakage of the diaphragm 11.

Figure 3:
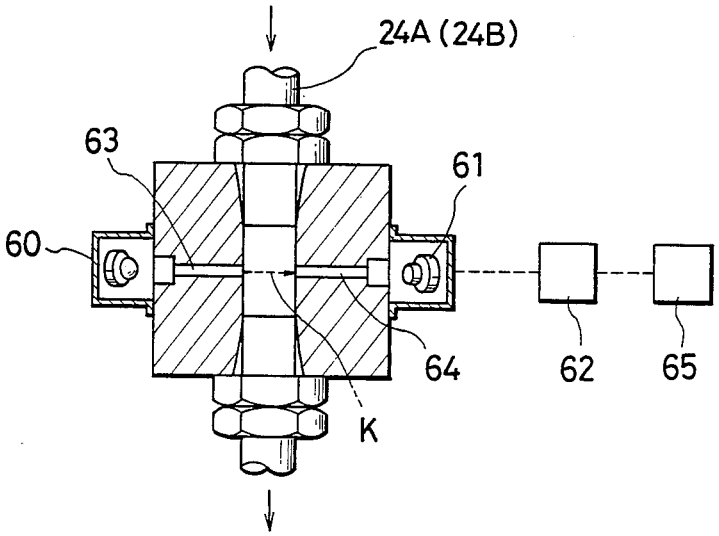

The optical detection means shown in FIG. 3 comprises a light emitting element 60 and a photoreceiving element 61 which are disposed on both sides of discharge channel 24A, 24B for hydraulic fluid so that the light emitted from the light emitting element 60 and transmitted along an optical path K through the hydraulic fluid is detected by the photoreceiving element 61, and a detection device 62 that checks the change of the transparency of the hydraulic fluid based on the detection output of the photoreceiving element 61.

When the light outgoing from the light emitting element 60 and passed through an optical fiber 63 transmits through the hydraulic fluid in the discharge flow channel 24A, 24B and then inputted through the optical fiber 64 to the photoreceiving element 61, the intensity of the light detected by the element 61 is inputted to the detection device 62. The light emitting element 60 may be a light emitting diode or the like, while the photoreceiving element or device may be a photodiode or phototransistor.

An alarm device 65 that generates an alarm sound or flickers an alarm lamp is connected to the detection device 62 and so adapted that it is actuated when the intensity of light inputted to the light receiving device 61 is decreased below a predetermined level.

In view of the optical detection, the hydraulic fluid used is, desirably, a transparent fluid such as dioctyl phthalate or an aliphatic ester of neopentyl polyol.

If the diaphragm 11 should happen to be broken, the hydraulic fluid passing through the discharge channel 24A, 24B becomes turbid by the mixing of the coating material, by which the intensity of the light transmitting through the hydraulic fluid is decreased and the breakage of the diaphragm 11 can be detected rapidly.

Mixing of the coating material in the hydraulic fluid may, alternatively, be detected based on the wavelength of the light passing through the hydraulic fluid, that is, based on the change in the color of the hydraulic fluid when the coating material is mixed.

In a case where a transparent coating material is used and no remarkable optical change is observed upon mixing into the hydraulic fluid, a color developer that can react with the coating material to develop a color may be contained in the hydraulic fluid. For instance, in a case where an aqueous alkaline coating material, for example, containing amines as the dispersant for paint material, phenolphthalein is dissolved as a color indicator in a neutral hydraulic fluid. In this case, if the diaphragm 11 is broken and the alkaline coating material is mixed into the hydraulic fluid, the indicator turns red to indicate the presence of the coating material in the hydraulic fluid.

In the case of using a resinous coating material dissolved in an organic solvent, a colorant sealed in a solvent-soluble container may be used as a coating material detector.

Figure 4:
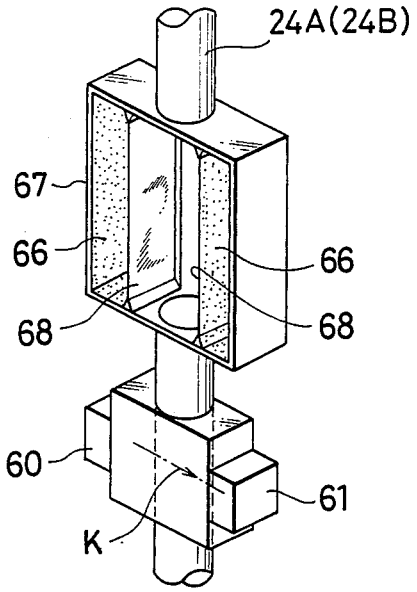

FIG. 4 shows one embodiment for such detection means, in which a container 67 having a colorant 66 sealed therein is connected at the midway of the discharge channel 24A, 24B to the upstream of the optical path K of the light emitting element 60 shown in FIG. 3 and the colorant 66 in the container 67 is normally isolated from the hydraulic fluid by means of a plastic film 68 which is easily soluble to the solvent of the coating material.

As the colorant 66, ink, dye or toner not chemically attacking the plastic film 68 may be used.

The plastic film 68 usable herein may be made, for example, of those materials that are not dissolved by the actuation fluid but easily be dissolved by the solvent of the coating material such as toluene, xylene, ketone, ethyl acetate and methyl ethyl ketone. Polystyrene film, for example, is preferably used.

In this embodiment, if the coating material is mixed into the hydraulic fluid due to the cracking, etc. of the diaphragm 11, the plastic film in the container in contact with the stream of the fluid is dissolved by the solvent contained in the coating material to release the colorant 66 into the discharge channel 24A, 24B, whereby the intensity of the wavelength of light detected by the photoreceiving element 61 is changed and the breakage of the diaphragm 11 can reliably be detected.

Figure 5:
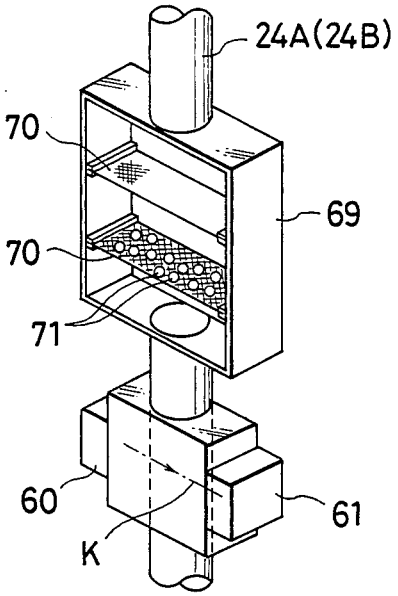

FIG. 5 shows another embodiment, in which detection means is disposed at the midway of the discharge channel 24A, 24B to the upstream of the optical path K of the light emitting element 60. Plastic capsules 71, 71, containing therein a colorant similar to that used in the embodiment shown in FIG. 4 are put between a pair of metal gages 70, 70 disposed at a predetermined distance to each other and in perpendicular to the flow direction of the hydraulic fluid in a container 69.

The capsules 71 are also made of polystyrene or like other plastic that is easily soluble to the coating material solvent.

Also in this case, if the coating material is mixed into the hydraulic fluid, the capsules 71 are dissolved by the solvent contained in the coating material to release the colorant contained therein, by which the intensity or the wavelength of the light detected by the photoreceiving element 61 is changed to reliably detect the breakage of the diaphragm 11.

Figure 6:
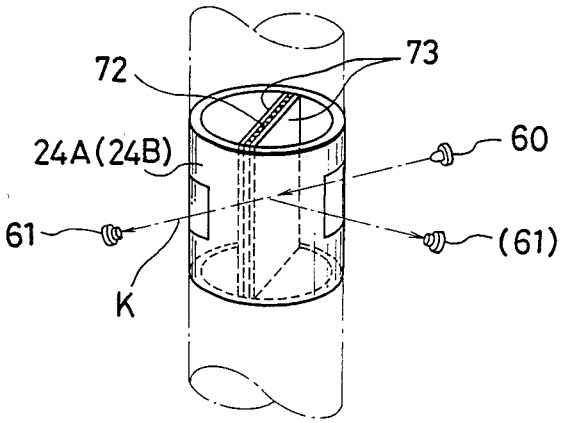

In a further embodiment of the optical detection means shown in FIG. 6, a porous transparent substrate 72 impregnated with a color developer that develops color upon reaction with the coating material is put between transprarent plates 73, 73 and secured in the discharge channel 24A, 24B. A light emitting element 60 and a photoreceiving device 61 are disposed opposing to each other on both sides of the substrate 72.

In this embodiment, if the coating material is mixed into the hydraulic fluid, the color developer impregnated in the substrate 72 develops a color in reaction with the coating material, to change the intensity or the wavelength of the light emitted from the light emitting element 60 and passed through the substrate in the hydraulic fluid, by which the output from the photoreceiving element 61 is changed and the breakage of the diaphragm 11 can be detected.

The photoreceiving device 61 may alternatively be adapted so as to detect the intensity or the wavelength of the light reflected at the surface of the substrate 72 in the hydraulic fluid.

In the embodiment shown in FIG. 1, the pressure sensor 40 and the pressure control valve 41 are used for controlling the pressure of the coating material supplied to a hydraulically-powered reciprocal pump going to be operated next in the operation sequence such that it is equal to the pressure of the coating material currently supplied to the coating machine 2 from a hydraulically-powered reciprocal pump being operated at present. However, the pressure control for the coating material is not restricted only to such an embodiment but the same effect can be obtained also by using a pressure control device 74 as shown in FIG. 7 through FIG. 10, instead of the pressure sensor 40 and the pressure control valve 41.

Each of the embodiments shown in FIG. 7 through FIG. 10 has a pressure control device 74 which equalizes the pressure of the hydraulic fluid supplied to the actuation fluid chamber 10 of the hydraulically-powered reciprocal pump 3A that currently supplies the coating material at a constant flow rate to the coating machine 2 with the pressure of the hydraulic fluid discharged from the actuation fluid chamber 10 in the other hydraulically-powered reciprocal pump 3B going to be operated next by the pressure of the coating material supplied to the coating material chamber 9 of the hydraulically-powered reciprocal pump 3B. The pressure control device 74 comprises a diaphragm (or piston) 75 actuated by the difference between the pressures of the hydraulic fluid acted on both sides thereof, and valves (79A and 79B) opened or closed by a needle 76 that moves interlocking with the diaphragm 75, in which the respective valves are so adapted that the discharge channel for the hydraulic fluid discharged from the hydraulically-powered reciprocal pump 3B is opened when the pressures of the hydraulic fluid acted on both sides of the diaphragm 75 are balanced.

Figure 7:
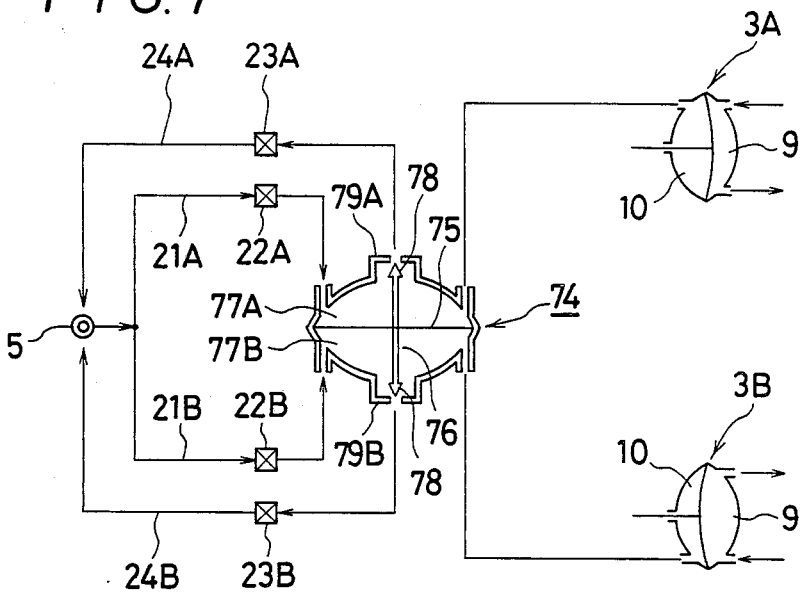

In the pressure control device 74 shown in FIG. 7, two static pressure chambers 77A and 77B formed in adjacent with each other by way of the diaphragm 75 are in communication with an hydraulic fluid supply source 5 by way of an hydraulic fluid supply channel 21A having an ON-OFF valve 22A disposed therein and an hydraulic fluid supply channel 21B having an ON-OFF valve 22B disposed therein respectively, and also connected to the hydraulic fluid chambers 10 of the hydraulically-powered reciprocal pumps 3A and 3B respectively.

The valve 79A is disposed to the static pressure chamber 77A and opened or closed by a popett 78 formed at one end of the needle 76, while the valve 79B is disposed to the static pressure chamber 77B and opened or closed by a popett 78 formed at the other end of the needle 76. The length of the needle 76 is designed such that both of the valves 79A and 79B are opened when the diaphragm 75 situates at a neutral position, that is, when the pressures in the static chambers 77A and 77B are balanced, whereas one of the valves 79A and 79B is closed when the pressures in the static chambers 77A and 77B are not balanced.

The valves 79A and 79B are connected to the hydraulic fluid supply source 5 by way of the hydraulic fluid discharge channel 24A having the ON-OFF valve 23A and the hydraulic fluid discharge channel 24B having the ON-OFF valve 23B respectively.

Referring to the operation, the ON-OFF valve, e.g., 22A is opened to supply the hydraulic fluid at a constant flow rate from the hydraulic fluid supply source 5 by way of the static pressure chamber **77*a* of the pressure control device 74 to the hydraulic fluid chamber 10 of the hydraulically-powered reciprocal pump 3A to pump out the coating material charged in the coating material chamber 9 of the hydraulically-powered reciprocal pump 3A at a constant flow rate and supply the coating material by a constant amount to the coating machine 2, meanwhile supply of the coating material is initiated from the coating material supply source 1 to the coating material chamber 9 of the hydraulically-powered reciprocal pump 3A** going to be operated next.

At the initial stage, the pressure of the hydraulic fluid discharged from the hydraulic fluid chamber 10 of the hydraulically-powered reciprocal pump 3B by the pressure of the coating material supplied to the hydraulically-powered reciprocal pump 3B is lower than the pressure of the hydraulic fluid supplied to the hydraulic fluid chamber 10 of the double-acting reciprocal pump 3A. Therefore, the diaphragm 75 of the pressure control device 74 displaces toward the static pressure chamber 77B to close the valve 79B of the chamber 77B with the needle 76. Accordingly, if the ON-OFF valve 23B is opened, the discharge channel 24B having the ON-OFF valve 23B disposed therein is closed by the valve 79B.

Then, the pressure of the coating material supplied from the coating material supply source 1 to the hydraulically-powered reciprocal pump 3B is gradually increased by the operation of the pump 13 (shown in FIG. 1) and, as the result thereof, the pressure of the hydraulic fluid discharged from the hydraulically-powered reciprocal pump 3B is increased.

Then, a balance state is attained between the pressures of the hydraulic fluid in the static pressure chambers 77A and 77B by which the needle 78 uprises to open the valve 79B and the hydraulic fluid in the hydraulic fluid chamber 10 of the hydraulically-powered reciprocal pump 3B is recycled through the discharge channel 24B to the hydraulic fluid supply source 5. Thus, the coating material is supplied into the coating material chamber 9 of the hydraulically-powered reciprocal pump 3B at the same pressure as the pressure of the actuation fluid being supplied from the hydraulic fluid supply source 5 to the hydraulically-powered reciprocal pump 3A (that is, at the same pressure as that of the coating material currently supplied from the hydraulically-powered reciprocal pump 3A to the coating machine 2).

Accordingly, upon switching the pump operation from one reciprocal pump 3A to the other hydraulically-powered reciprocal pump 3B, no pulsation is caused to the coating material being supplied to the coating machine 2.

Figure 8:
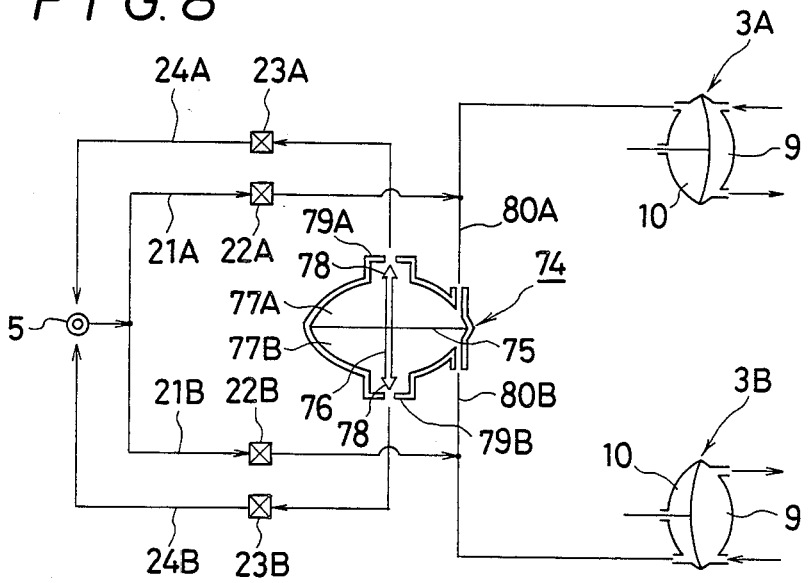

FIG. 8 shows another embodiment of the pressure control device 74 adapted so that the hydraulic fluid supplied under pressure from the hydraulic fluid supply source 5 through the supply channels 21A, 21B is directly supplied to the hydraulically-powered pump 3A, 3B not by way of the static pressure chamber 77A, 77B, while the pressure of the hydraulic fluid is exerted by way of branched channels 88A and 88B on both sides of the diaphragm 75 respectively.

Figure 9:
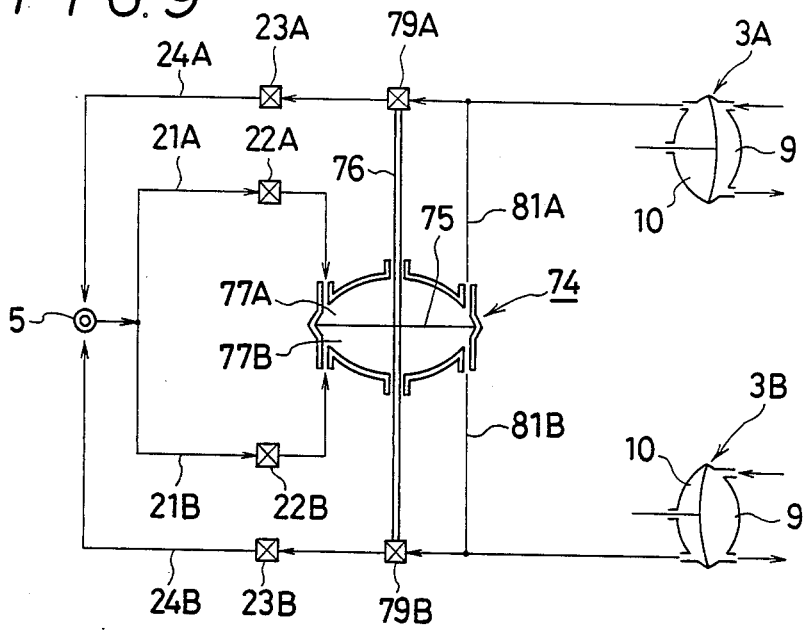

FIG. 9 shows a further embodiment of the pressure control device 74 adapted so that the hydraulic fluid discharged from each of the hydraulic fluid chambers 10 of the hydraulically-powered reciprocal pumps 3A, 3B is directly returned to the hydraulic fluid supply source 5 not by way of the static chamber 77A, 77B, while the pressure of the hydraulic fluid is exerted by way of branched channel 81A, 81B on both sides of the diaphragm 75 respectively.

In the embodiment shown in FIG. 9, valves 79A and 79B are disposed separately from the static pressure chambers 77A and 77B respectively.

Figure 10:
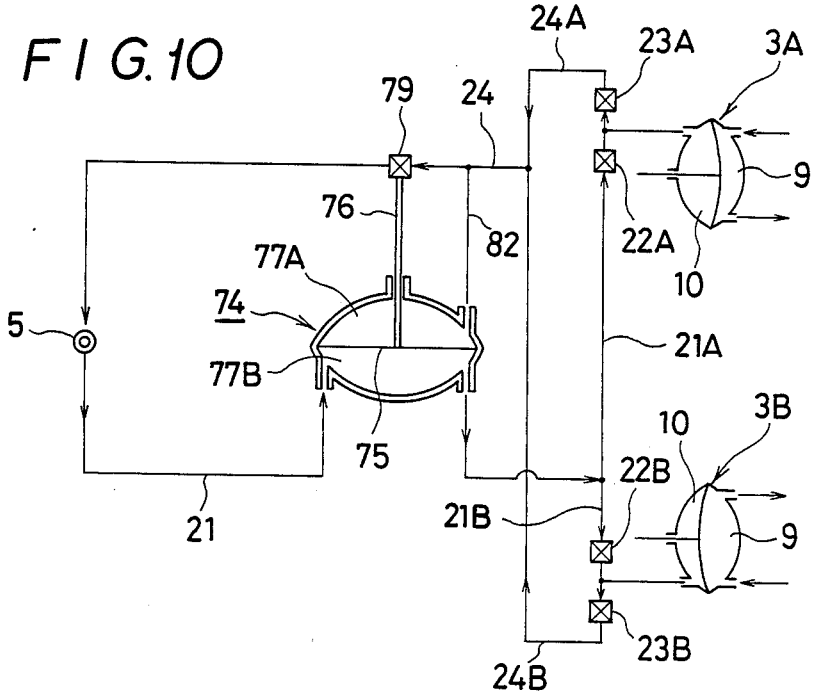

FIG. 10 shows a still further embodiment of the pressure control device 74. A static pressure chamber 77B is disposed to the flow channel 21 in communicationb from the hydraulic fluid supply source 5 to the supply channel 21A, 21B so that the hydraulic fluid supplied to the hydraulically-powered reciprocal pump 3A, 3B is caused to flow through the static chamber 77B. A flow channel 82 branched from the flow channel 24, which is in communication from the discharge channel 24A, 24B to the hydraulic fluid supply source 5, is connected to the static pressure chamber 77A. Further, a valve 79 opened and closed by a needle 76 is disposed only to the flow channel 24, to which the hydraulic fluid is discharged alternately from the hydraulically-powered reciprocal pumps 3A, 3B.

Figure 11:
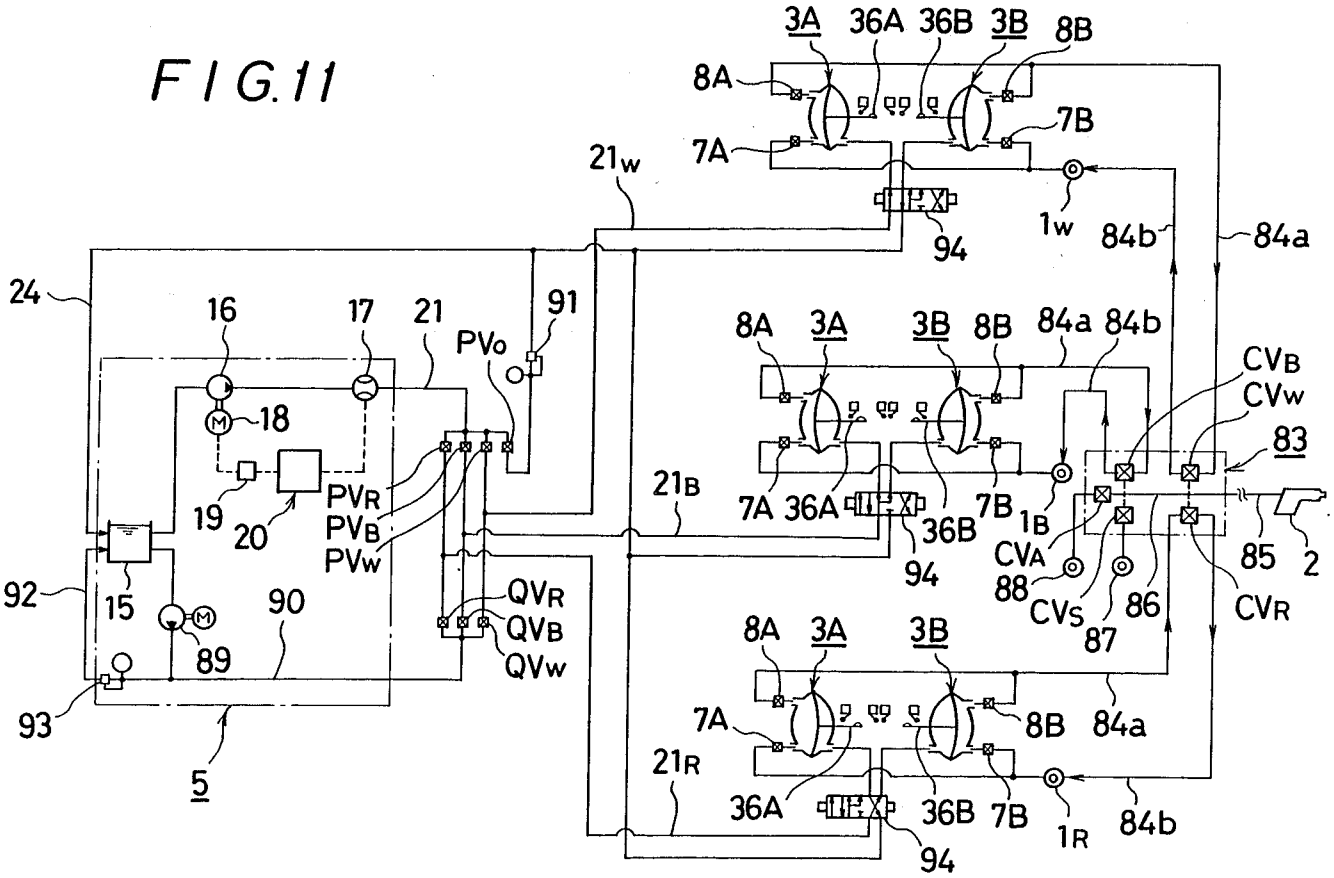

FIG. 11 is a flow sheet illustrating one embodiment of the present invention applied to a multicolor coating apparatus. Each one pair of the hydraulically-powered reciprocal pumps 3A, 3B as shown in FIG. 1 is connected to each of coating material selection valves $CV_W$, $CV_B$ and $CV_R$ of a color-change device 83 connected in parallel with the coating machine 2, as well as connected to each of first switching valves $PV_W$, $PV_B$ and $PV_R$ for selectively switching the first supply flow channel 21 that supplies the hydraulic fluid at a constant flow rate from the actuation fluid supply source 5 to each pair of the hydraulically-powered reciprocal pumps 3A, 3B in accordance with the switching operation of the coating material selection valves $CV_W$, $CV_B$ and $CV_R$. Further, a flow rate control mechanism comprising a flow sensor 17, a flow rate control device 20, etc. is disposed at the midway of the supply channel 21 of the hydraulic fluid between the hydraulic fluid supply source 5 and the switching valves $PV_W$, $PV_B$ and $PV_R$.

Each pair of the hydraulically-powered reciprocal pumps 3A. 3B is so adapted that is always circulates the paint supplied from the coating material supply source $1_W$ for white paint, the coating material supply source $1_B$ for black paint and the coating material supply source $1_R$ for red paint in such a way that the paint is discharged to a forward recycling channel 84*a*, passed through each of the coating material selection valves $CV_W$, $CV_R$ and $CV_R$ and then returned through a backward recycling channel 84*b* again to each of the coating material supply sources $1_W$, $1_B$ and $1_R$.

In the color-change device 83, each of the coating material selection valves $CV_W$, $CV_B$ and $CV_R$, a solvent selection valve $CV_S$ supplied with a cleaning solvent for color-change from a solvent supply source 87 and an air selection valve $CV_A$ supplied with pressurized cleaning air for color change from an air supply source 88 are connected to the manifold 86 connected by way of a paint hose 85 to the coating machine 2, so that each of the valves are opened and closed selectively.

The hydraulic fluid supply source 5 comprises a first supply channel 21 in which the flow rate of the hydraulic fluid supplied under pressure from the reservoir 15 by the pump 16 is always maintained constant in accordance with the flow rate of the coating material supplied to the coating machine 2 and a second supply channel 90 for supplying the hydraulic fluid under pressure in the reservoir 15 by the pump 89 irrespective of the flow rate of the coating material supplied to the coating machine 2.

In the first supply channel 21, each of switching valves $PV_W$, $PV_B$ and $PV_R$ connected to each of the hydraulically-powered double-acting reciprocal pumps 3A, 3B, and a switching valve $PV_O$ connected to the discharge channel 24 for recycling the hydraulic fluid discharged from each pair of the hydraulically-powered reciprocal pumps 3A, 3B into the reservoir 15 are connected in parallel with each other to the supply channel 21. Further, a back pressure valve 91 is disposed between the switching valve $PV_O$ and the discharge channel 24.

In the second supply channel 90, second switching valves $QV_W$, $QV_B$ and $QV_R$ are connected in parallel with each other to the hydraulic fluid supply channels $21_W$, $21_B$ and $21_R$ that connect the respective pair of the hydraulically-powered reciprocal pumps 3A, 3B with the first switching valves $PV_W$, $PV_B$ and $PV_R$ respectively, as well as a return channel 92 connected directly to the reservoir 15 is connected.

A back pressure valve 93 is disposed to the return channel 92.

Piston valves 94 are disposed between the hydraulic fluid discharge channel 24 and respective hydraulic fluid supply channels $21_W$, $21_B$ and $21_R$ for alternately supplying the hydraulic fluid to each pair of the hydraulically-powered reciprocal pumps 3A and 3B.

Each of the piston valves 94 is adapted to be switched for three states at a predetermined timing by a limit switch operated by rods 36A, 36B interlocking with the diaphragm 11 of each pair of the hydraulically-powered reciprocal pumps 3A, 3B.

The operation of the coating material supply device having the constitution as shown in FIG. 11 will be explained.

At first, the pumps 16 and 89 disposed to the hydraulic fluid supply source 5 are operated simultaneously to supply the hydraulic fluid in the reservoir 15 under pressure through both of the first supply channel 21 and the second supply channel 90.

Since all of the coating material selection valves $CV_W$, $CV_B$ and $CV_R$ of the color-change device 83 are closed before starting the coating, all of the first switching valves $PV_W$, $PV_B$ and $PV_R$ corresponding to them are also closed, while only the switching valve $PV_O$ is opened. Accordingly, the hydraulic fluid supplied under pressure at the constant flow rate through the first supply channel 21 is directly recycled to the reservoir 15 of the hydraulic fluid supply source 5 from the switching valve $PV_O$ by way of the discharge channel 24.

While on the other hand, all of the second switching valves $QV_W$, $QV_B$ and $QV_R$ are kept open and the hydraulic fluid supplied under pressure at an optional flow rate through the second supply channel 90 is supplied from each of the switching valves $QV_W$, $QV_B$ and $QV_R$ through each of the supply channels $21_W$, $21_B$ and $21_R$ to each pair of the hydraulically-powered reciprocal pumps 3A, 3B.

That is, each pair of the hydraulically-powered reciprocal pumps 3A, 3B continuously pumps out the paint of each color by the optional pressure of the hydraulic fluid supplied from the second supply channel 90 and supplies the paint recyclically to each of the coating material selection valves $CV_W$, $CV_B$ and $CV_R$.

Accordingly, it is possible to prevent the paint supplied by the coating material supply sources $1_W$, $1_B$ and $1_R$ from depositing to the inside of the forward recycling channel 84a or to the inside of the return recycling channel 84b, which can prevent clogging in the nozzle of the coating machine 2 or the defective coating due to generation of coarse grains.

In the case of starting coating, for example, with white paint in this state, the coating material selection valve $CV_W$ is switched so that it connects the forward recycling channel 84a with the manifold 86 in communication with the paint hose 85, while the first switching valve $PV_W$ is opened in response to the operation of the switching valve $CV_W$ and the switching valve $PV_O$ is closed. Further, the second switching valve $QV_W$ is closed simultaneously therewith.

Thus, the hydraulic fluid is supplied at a constant flow rate from the hydraulic fluid supply source 5 through the supply channels 21 and $21_W$ to the hydraulically-powered reciprocal pumps 3A, 3B already charged with the white paint from the coating material supply source $1_W$, and the white paint is discharged at a predetermined flow rate from the pair of hydraulically-powered pumps 3A, 3B operated alternatively by the switching operation of the piston valve 94 and supplied at a constant amount to the coating machine 2 by way of the forward recycling channel 84a→manifold 86→paint hose 85.

Then, when the color-change is conducted from the white to the black paint after the completion of the coating with the white paint, the forward recycling channel 84a for the white paint is again connected to the backward recycling channel 84b by the switching of the coating material selection valve $CV_W$ and, in response to the operation of the valve $CV_W$, the first switching valve $PV_W$ is closed, while the switching valve $PV_O$ is opened. Further, the second switching valve $QV_W$ is again opened simultaneously therewith.

Then, the solvent selection valve $CV_S$ and the air selection valve $CV_A$ are alternately opened and closed to wash and remove the white paint remaining in the paint hose 85 and the coating machine 2 with the solvent and the pressurized air supplied from the solvent supply source 87 and the air supply source 88 by way of the manifold 86.

In this way, when the washing for color-change has been completed, the coating material selection valve $CV_B$ is switched so that it connects the forward recycling channel 84 for the black paint with the manifold 86 in communication to the paint hose 85 and, in response to the switching operation of the valve $CV_B$, the first switching valve $PV_B$ is opened, while the switching valve $PV_O$ is closed. Further, the second switching valve $QV_S$ is closed simultaneously therewith.

Thus, the hydraulic fluid is supplied at a constant flow rate from the hydraulic fluid supply source 5 through the supply channels 21 and $21_B$ to the hydraulically-powered reciprocating pumps 3A, 3B already supplied with the black paint from the coating material supply source $1_B$, and the black paint is discharged at a predetermined flow rate from the alternately operating paired hydraulically-powered reciprocal pumps 3A, 3B by the switching of the piston valve 94 and is supplied at a constant amount to the coating machine by way of the forward recycling channel 84a→manifold 86→paint hose 85.

In the constitution as has been described above, since only one set of the flow sensor 17 and the flow rate control device 20 is necessary for maintaining the flow rate of the paint of each color constant even in a case of multicolor coating apparatus that conducts color-change for more than 30 to 60 kinds of colors and it is no more necessary to dispose such a set to each color paint as usual, the installation cast can significantly be reduced.

It is of course possible to adopt various kinds of mechanisms as described above referring to FIGS. 1 to 10 for the coating material supply device shown in FIG. 11.

The hydraulically-powered reciprocal pump 3A, 3B are not restricted only to those using the diaphragm 11 but it may be a piston by the pump.

What is claimed is:

1. A coating material supply device in which coating material is pumped out at a predetermined flow rate and supplied at a constant flow rate to a coating machine, wherein said device comprises:

a plurality of hydraulically-powered reciprocal pumping means connected in parallel with each other to said coating machine and adapted to be operated successively and selectively in a predetermined operation sequence, each of said pumping means having a flow channel with an inlet for the coating material supplied from a coating material supply source and an exit to a flow channel for discharging the coating material to said coating machine by the pressure of hydraulic fluid supplied through respective flow channels at a constant flow rate from a hydraulic fluid supply source to the respective said pumping means, for introducing and discharging hydraulic fluid, and a plurality of ON-OFF valves respectively disposed in each said flow channel to the inlet and in each said flow channel from the exit for the coating material, and in each said flow channel for introducing and discharging the hydraulic fluid, and timer means operated interlocking with the movement of each of said pumping means for putting each of said ON-OFF valves to ON-OFF control at a predetermined timing, in which each of said pumping means being adapted such that the respective ON-OFF valve disposed in the respective flow channel to the exit for the coating material is closed preceding the introduction of the coating material by the opening of the respective ON-OFF valve disposed in the respective flow channel to the respective inlet for the coating material while the respective ON-OFF valve disposed in the respective flow channel to the respective inlet for the coating material is closed preceding the discharge of the coating material by the opening of said ON-OFF valve disposed to said exit, as well as that the respective ON-OFF valve disposed in the respective flow channel for introducing the hydraulic fluid is closed preceding the discharge of the coating material by the opening of both the respective ON-OFF valves disposed in the respective flow channel to the respective exit for the coating material and in the respective flow channel for introducing the hydraulic fluid, while the respective ON-OFF valve disposed in the flow channel for discharging the hydraulic fluid is closed preceding the introduction of the coating material by the opening of both the ON-OFF valves disposed in the respective flow channel for discharging the hydraulic fluid and in the respective flow channel to the respective inlet for the coating material, and in which the respective ON-OFF valve disposed in the flow channel for introducing the hydraulic fluid of a respective said pumping means which is to be operated next in the predetermined sequence is opened just before the closure of the respective ON-OFF valve of the respective said pumping means which has been under operation preceding to such next-to-be-operated pumping means.

2. A coating material supply device in which coating material is pumped out at a predetermined flow rate and supplied at a constant flow rate to a coating machine, wherein said device comprises:

a plurality of hydraulically-powered reciprocal pumping means connected in parallel with each other to said coating machine and adapted to be operated successively and selectively in a predetermined sequence, each of said pumping means having an inlet for the coating material supplied from a coating material supply source and an exit for discharging said coating material by the pressure of hydraulic fluid supplied at a constant flow rate from a hydraulic fluid supply source, and a pressure control device that controls the pressure of the hydraulic fluid supplied to a respective said hydraulically-powered pumping means which is currently supplying the coating material to said coating machine equal to the pressure of the hydraulic fluid discharged from a respective said hydraulically-powered pumping means which is to be operated next in the operation sequence by the pressure of the coating material supplied thereto, in which said pressure control device comprises a diaphragm or piston actuated by the difference of pressures of said hydraulic fluids acted on both sides thereof and valves opened and closed by a needle interlocking with said diaphragm or piston, said valve causing to open the flow channel of the hydraulic fluid discharged from said hydraulically-powered pumping means when the pressures of both of the hydraulic fluids acting on both sides of said diaphragm or piston are balanced to each other.

3. A coating material supply device in which coating material is pumped out at a predetermined flow rate and supplied at a constant flow rate to a coating machine, wherein said device comprises:

a plurality of hydraulically-powered reciprocal pumping means connected in parallel with each other to said coating machine and adapted to be operated successively and selectively in a predetermined sequence, each of said pumping means having an inlet for the coating material supplied from a coating material supply source and an exit for discharging said coating material by the pressure of hydraulic fluid supplied at a constant flow rate from a hydraulic fluid supply source, a pressure sensor for detecting the pressure of the coating material being supplied from each of said pumping means to said coating machine and providing a pressure detection signal corresponding thereto, a pressure control valve that controls the pressure of the coating material supplied to the respective said pumping means to be operated next in the operation sequence to the same level as that for the pressure of the coating material being supplied at a constant flow rate to the coating machine based on said pressure detection signal of said pressure sensor, and means operatively connecting said pressure sensor with said pressure control valve for communicating said pressure detection signal to said pressure control valve.

4. A coating material supply device as defined in claim 3, wherein:

the pressure control valve is disposed to the flow channel for the coating material supplied from the coating material supply source to each of said hydraulically-powered pumping means.

5. A coating material supply device as defined in claim 3, wherein:

the pressure control valve is disposed to the flow channel for the hydraulic fluid discharged from each of the hydraulically-powered pumping means by the pressure of the coating material supplied from the coating material supply source to each of the hydraulically-powered pumping means.

* * * * *